US007121620B1

(12) United States Patent
Fang

(10) Patent No.: US 7,121,620 B1
(45) Date of Patent: Oct. 17, 2006

(54) FOLDABLE BATH BENCH

(75) Inventor: James Fang, Taipei (TW)

(73) Assignee: Hui Zhou Andon Industries Co., Ltd., Gong Dong Province (CN)

( * ) Notice: Subject to any disclaimer, the term of this patent is extended or adjusted under 35 U.S.C. 154(b) by 0 days.

(21) Appl. No.: 11/202,346

(22) Filed: Aug. 12, 2005

(51) Int. Cl.
*A47C 4/00* (2006.01)

(52) U.S. Cl. ..... 297/51; 297/183.9; 297/440.24

(58) Field of Classification Search ..... 297/16.1, 297/51, 440.24, 183.9, 423.41
See application file for complete search history.

(56) References Cited

U.S. PATENT DOCUMENTS 2,619,154 A * 11/1952 Erickson ..... 297/423.41 X
5,845,962 A * 12/1998 Lin ..... 297/16.1
6,039,403 A * 3/2000 Hargroder ..... 297/440.24

* cited by examiner

*Primary Examiner*—Anthony D. Barfield
(74) *Attorney, Agent, or Firm*—Rosenberg Klein & Lee

(57) ABSTRACT

A foldable bath bench has a seat assembly and two leg assemblies. The seat assembly has a front, a rear, two opposite sides, two transverse crossbars and at least one seat. The transverse crossbars are mounted respectively at the front and rear, and each transverse crossbar has two opposite ends. The at least one seat is mounted on the transverse crossbars. The leg assemblies are mounted on the opposite sides of the seat assembly, and each leg assembly has two bracket assemblies, and two vertical supports and two legs. The vertical supports are attached respectively to the bracket assemblies and are able to pivot relative to the ends of the transverse crossbars. The legs are mounted respectively on the vertical supports. The foldable bath bench becomes more compact by folding the vertical supports of the leg assemblies relative to the seat assembly for carrying and storage.

8 Claims, 5 Drawing Sheets

FOLDABLE BATH BENCH

BACKGROUND OF THE INVENTION

1. Field of the Invention

The present invention relates to a bench, and more particularly to a foldable bath bench that has multiple foldable legs and can be folded into a compact state for storage or carrying.

2. Description of Related Art

Bath benches are used generally in the nursing field to allow a caregiver to put a patient unable to move by himself on a bath bench and give the patient a bath.

A conventional bath bench is so large that the conventional bath bench usually has to be stored somewhere other than in the bathroom. However, the conventional bath bench cannot be folded or easily disassembled and is hard to carry and store.

With reference to FIG. 5, a conventional bath bench (90) has a seat (91), two leg brackets (93) and four telescopic legs (95).

The seat (91) has two opposite sides. The leg brackets (93) are mounted on the opposite sides of the seat (91). Each leg bracket (93) has two vertical supports (931). Each vertical support (931) has a positioning button extending retractably from the vertical support (931). The telescopic legs (95) are mounted telescopically respectively around the vertical supports (931), and each telescopic leg (95) has multiple through holes defined through the telescopic leg (95) and corresponding to the buttons on the vertical supports (931).

To adjust the height of the seat (91), each telescopic leg (95) moves along the vertical support (931) to an appropriate position, and the button on the vertical support (931) extends through one of the through holes to hold the telescopic leg (95).

The conventional bath bench (90) is made somewhat compact by retracting the telescopic legs (95). However, the conventional bath bench (90) with the retracted telescopic legs (95) is still large and cumbersome.

To overcome the shortcomings, the present invention provides a foldable bath bench to mitigate or obviate the aforementioned problems.

SUMMARY OF THE INVENTION

The main objective of the invention is to provide a foldable bath bench that has four foldable vertical supports. The foldable bath bench becomes more compact by folding the foldable vertical supports for storage or carrying.

A foldable bath bench in accordance with the present invention comprises a seat assembly and two leg assemblies.

The seat assembly has a front, a rear, two opposite sides, two transverse crossbars and at least one seat. The transverse crossbars are mounted respectively at the front and rear, and each transverse crossbar has two opposite ends. The at least one seat is mounted on the transverse crossbars.

The leg assemblies are mounted on opposite sides of the seat assembly, and each leg assembly has two bracket assemblies, two vertical supports and two legs. The vertical supports correspond to and are mounted respectively on the bracket assemblies and are able to pivot relative to the ends of the transverse crossbars. The legs are mounted respectively on the vertical supports.

Other objectives, advantages and novel features of the invention will become more apparent from the following detailed description when taken in conjunction with the accompanying drawings.

DETAILED DESCRIPTION OF PREFERRED EMBODIMENT

Figure 1:
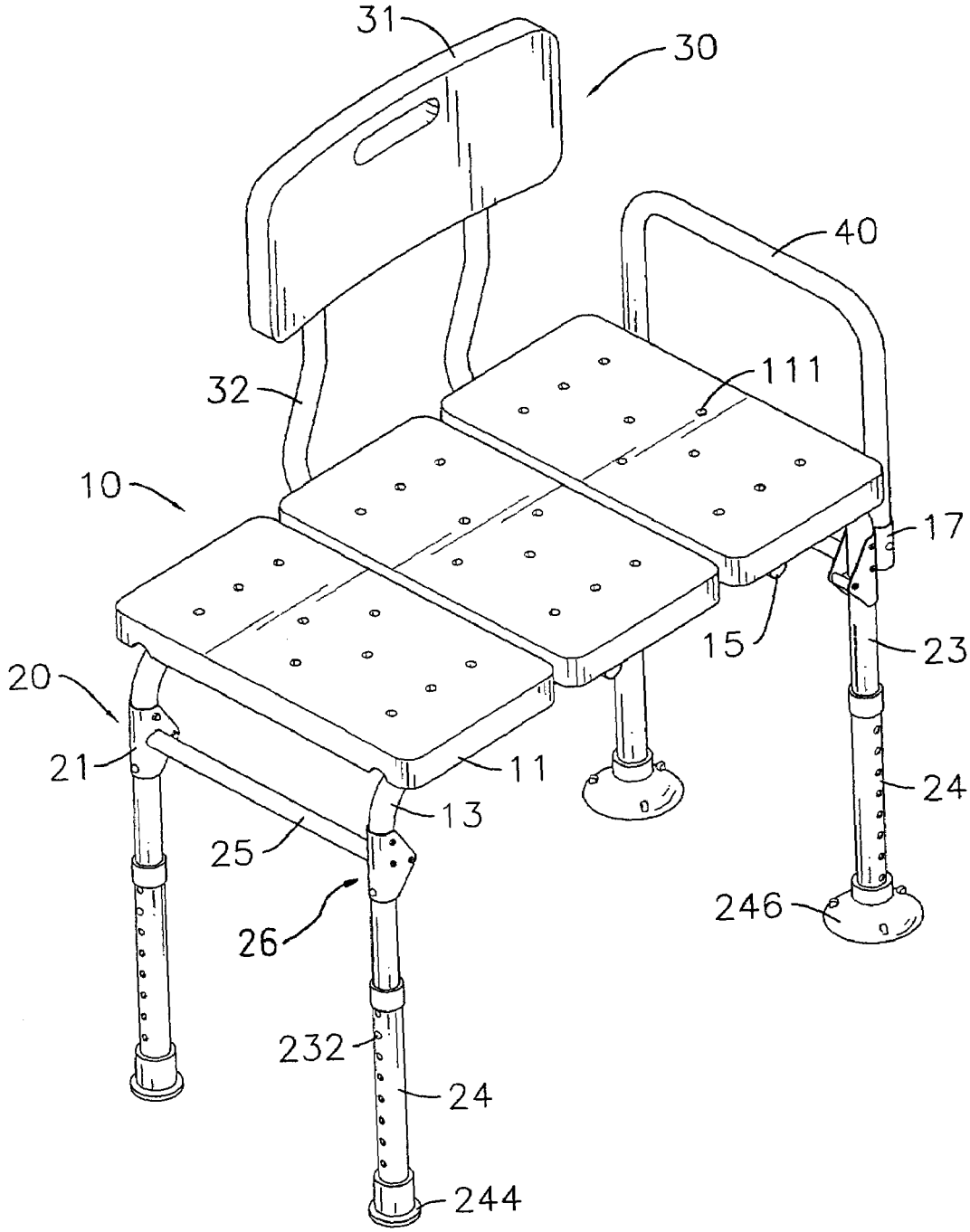
FIG. 1 is a perspective view of a foldable bath bench in accordance with the present invention.

With reference to FIG. 1, a foldable bath bench in accordance with the present invention comprises a seat assembly (10), two leg assemblies (20), a backrest assembly (30) and an armrest (40).

The seat assembly (10) has a front, a rear, two opposite sides, two transverse crossbars (13), at least one seat (11), two backrest brackets (15), and two armrest brackets (17). The transverse crossbars (13) are mounted respectively at the front and rear, and each transverse crossbar (13) has two opposite ends. The at least one seat (11) is mounted on the transverse crossbars (13) and has multiple through holes (111). The through holes (111) are defined vertically through the at least one seat (11) to allow water to pass through the through holes (111) when the bath bench is used in a bathroom with a patient taking a bath. The backrest brackets (15) may be hollow tubes mounted longitudinally below the transverse crossbars (13). The armrest brackets (17) are hollow, are mounted respectively on the transverse crossbars (13) at corresponding ends of the transverse crossbars (13).

Figure 2:
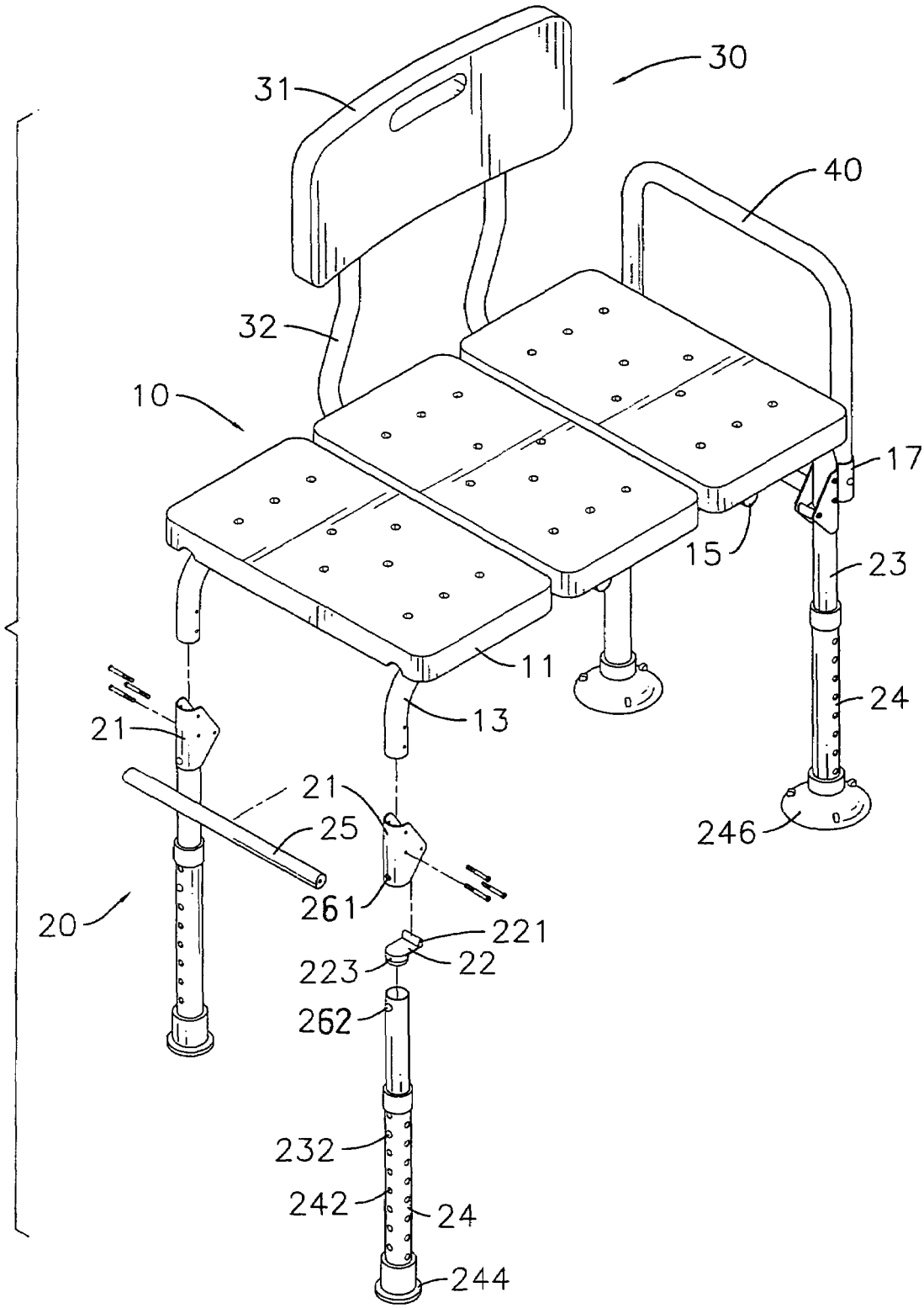
FIG. 2 is a partially exploded perspective view of the foldable bath bench in FIG. 1.

With further reference to FIG. 2, the leg assemblies (20) are mounted on the opposite sides of the seat assembly (10), and each leg assembly (20) has two bracket assemblies, two vertical supports (23), two pivot latch assemblies (26), two legs (24) and a reinforcing crossbar (25).

The bracket assemblies correspond to and are mounted respectively on the ends of the transverse crossbars (13) on the same side of the seat assembly (10). A preferred embodiment of the bracket assembly has a U-shaped bracket (21), a pivot pin and a hinge plug (22). The U-shaped bracket (21) is attached securely to the end of the corresponding transverse crossbar (13). The hinge plug (22) is attached pivotally to the U-shaped bracket (21) and has a proximal end, a distal end, a barrel (221) and a plug (223). The barrel (221) is formed on the proximal end and is attached pivotally to the U-shaped bracket (21) with the pivot pin. The plug (223) is formed on and protrudes from the distal end.

The vertical supports (23) are attached respectively to the bracket assemblies and selectively pivot relative to the ends of the transverse crossbars (13). Each vertical support (23) has an upper end, a lower end and a retractable latch (232). The upper ends of the vertical supports (23) are mounted respectively on the plugs (223) of the hinge plugs (22). The retractable latch (232) protrudes from the vertical support (23) close to the lower end.

The pivot latch assemblies (26) keep the vertical supports (23) from inadvertently folding, are formed on the bracket assemblies and the vertical supports (23) and may be implemented with locking holes (261) and retractable latches (262). The locking holes (261) are defined respectively in the U-shaped brackets (21). The retractable latches (262) protrude respectively from the vertical supports (23) near the upper ends and engage the locking holes (261) in the U-shaped brackets (21) to keep the vertical supports (23) from inadvertently collapsing.

The legs (24) are hollow, are mounted respectively around the lower ends the vertical supports (23) and may be telescopically mounted around the vertical supports (23). Each leg (24) has a lower end, multiple locking holes (242) and a bottom pad. The locking holes (242) are defined in a longitudinal line through each leg (24) and correspond to the retractable latch (232) on the vertical support (23). The bottom pad is mounted on the lower end of the leg (24). A preferred embodiment of the bottom pad is implemented with a nonskid rubber foot (244) or a rubber suction cup (246). A preferred embodiment of the leg assemblies (20) has two nonskid rubber feet (244) mounted respectively on the lower ends of the legs (24) of one leg assembly (20) and two rubber suction cups (246), on those of the other leg assembly (24). The foldable bath bench is held tightly on a bathroom floor with the nonskid rubber feet (244) and the two rubber suction cups (246).

The reinforcing crossbars (25) are mounted securely between the U-shaped brackets (21) of the bracket assemblies respectively of the leg assemblies (20) to synchronize the movement of the vertical supports (23) and the legs (24) of the leg assemblies (20).

The backrest assembly (30) is mounted detachably on the seat assembly (10) and has a backrest (31) and two mounting tubes (32). The mounting tubes (32) are attached to the backrest (31) and have two distal ends detachably mounted in the backrest brackets (15) of the seat assembly (10).

The armrest (40) is mounted detachably on the seat assembly (10) and has two ends detachably mounted in the armrest brackets (17) of the seat assembly (10).

Figure 3:
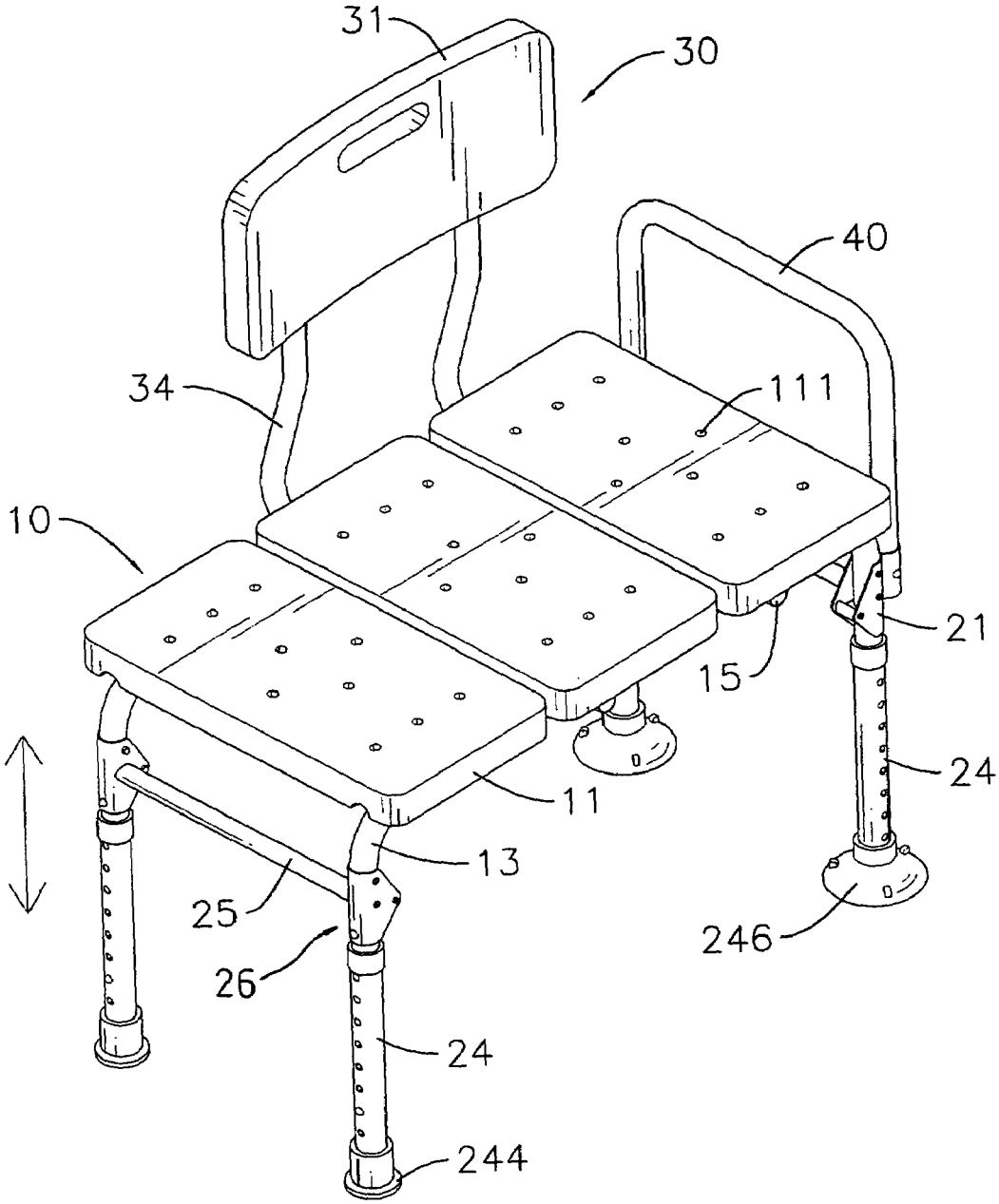
FIG. 3 is an operational perspective view of the foldable bath bench in FIG. 1.

With reference to FIG. 3, the legs (24) slide respectively on the vertical supports (23) when the retractable latches (232) on the vertical supports (23) are depressed to make the vertical supports (23) completely extend into the legs (24). When the legs (24) are completely extended, the retractable latches (232) on the vertical supports (23) extend respectively through the uppermost locking holes (242) in the legs (24) to keep the legs (24) extended.

Figure 4:
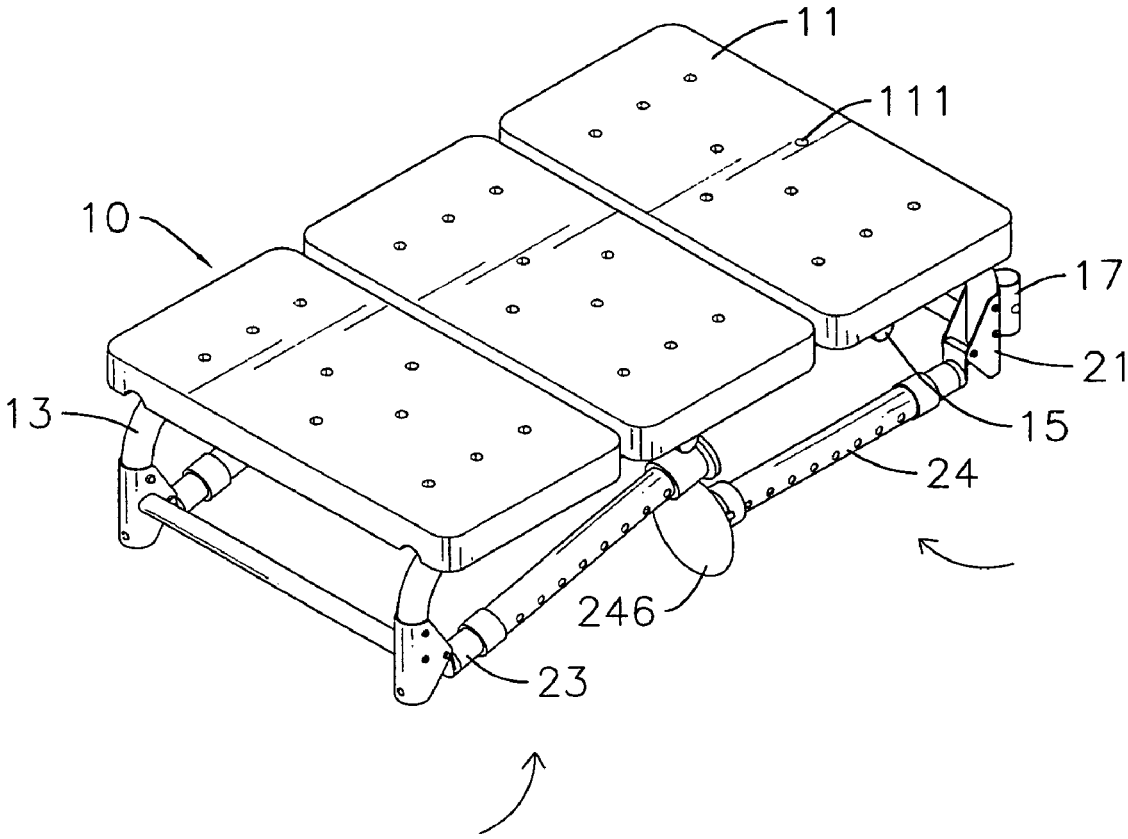
FIG. 4 is an operational perspective view of the foldable bath bench in FIG. 3 in a folded state.
Figure 5:
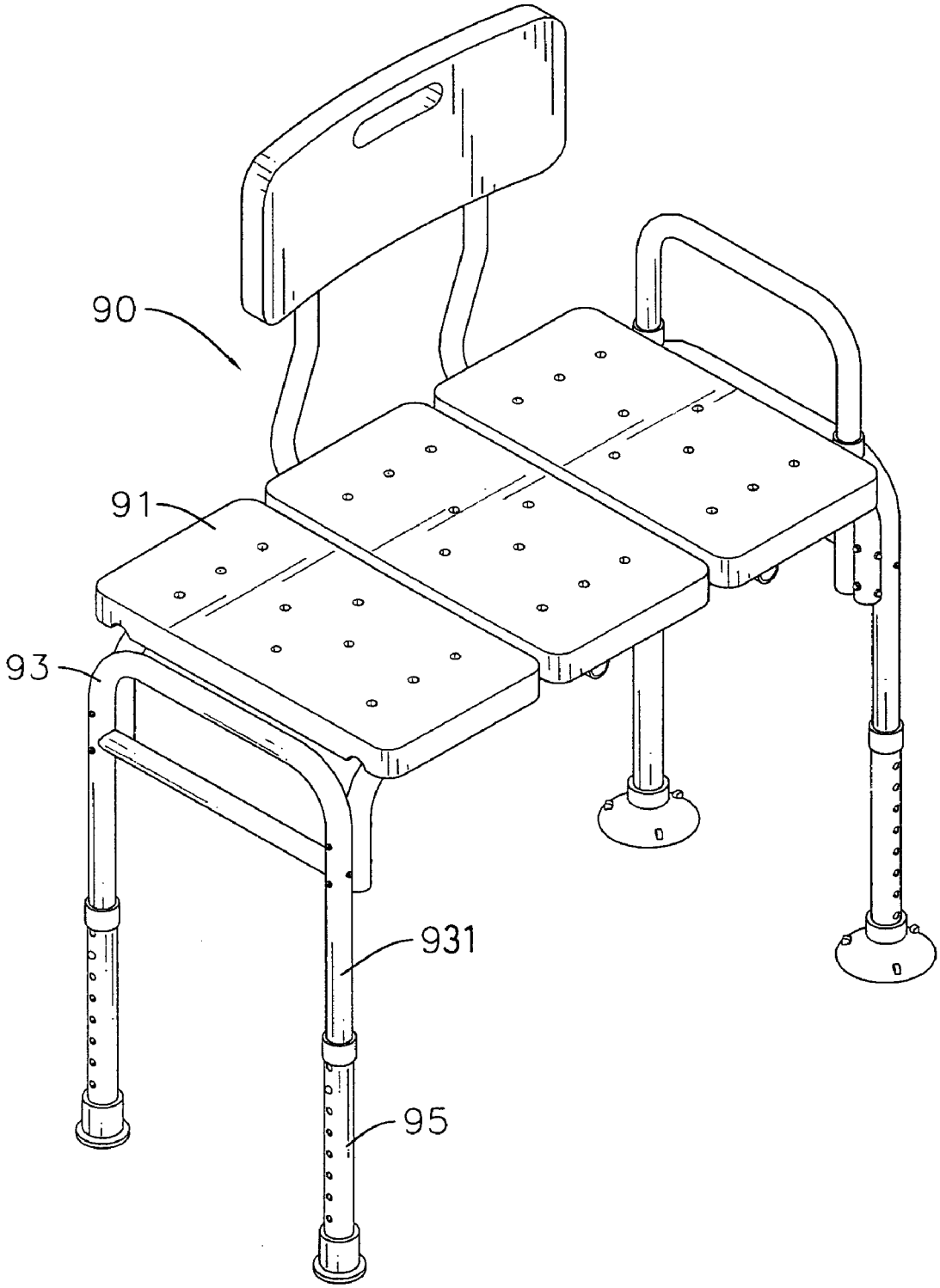
FIG. 5 PRIOR ART
FIG. 5 is a perspective view of a conventional bath bench in accordance with the prior art.

With reference to FIG. 4, the vertical supports (24) of the leg assemblies (20) fold relative to and are parallel to the seat assembly (10) below the at least one seat (10) so the foldable bath bench becomes more compact and for storage or carrying.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A foldable bath bench comprising:

a seat assembly having a front;

a rear;

two opposite sides;

two transverse crossbars mounted respectively at the front and rear, and each transverse crossbar having two opposite ends; and at least one seat mounted on the transverse crossbars; and two leg assemblies mounted on the opposite sides of the seat assembly, and each leg assembly having:

two bracket assemblies corresponding to and mounted respectively on the ends of the transverse crossbars, each bracket assembly having:

a U-shaped bracket attached securely to the end of a corresponding transverse crossbar;

a pivot pin; and a hinge plug attached pivotally on the U-shaped bracket and having a proximal end, a distal end, a barrel formed on the proximal end and attached pivotally to the U-shaped bracket with the pivot pin, and a plug formed on and protruding from the distal end;

two vertical supports attached respectively to the bracket assemblies, selectively pivoting relative to the ends of the transverse crossbars, and each vertical support having an upper end and a lower end, the upper end of each vertical support being mounted respectively on the plugs of the hinge plugs;

two pivot latch assemblies formed on the bracket assemblies and the vertical supports to keep the vertical supports from inadvertently folding; and two legs mounted respectively around the vertical supports, and each leg having a lower end.

2. The foldable bath bench as claimed in claim 1, wherein each leg further has a bottom pad mounted on the lower end.

3. The foldable bath bench as claimed in claim 2, wherein the bottom pads of one leg assembly are implemented with two nonskid rubber feet and the bottom pads of the other leg assembly are implemented with two rubber suction cups.

4. The foldable bath bench as claimed in claim 1, wherein each leg assembly further has a reinforcing crossbar mounted between the U-shaped brackets of the bracket assemblies.

5. The foldable bath bench as claimed in claim 1, wherein:

the seat assembly further has two armrest brackets being hollow, mounted respectively on the transverse crossbars at corresponding ends of the transverse crossbars; and the foldable bath bench further has an armrest mounted detachably on the seat assembly and having two ends detachably mounted in the armrest brackets of the seat assembly.

6. The foldable bath bench as claimed in claim 1, wherein the at least one seat has multiple through holes defined vertically through the at least one seat.

7. A The foldable bath bench comprising:

a seat assembly having a front;

a rear;

two opposite sides;

two transverse crossbars mounted respectively at the front and rear, and each transverse crossbar having two opposite ends; and at least one seat mounted on the transverse crossbars; and two leg assemblies mounted on the opposite sides of the seat assembly and each leg assembly having:

two bracket assemblies corresponding to and mounted respectively on the ends of the transverse crossbars;

two vertical supports attached respectively to the bracket assemblies, selectively pivoting relative to the ends of the transverse crossbars and each vertical support having an upper end and a lower end, each vertical support further having a retractable latch extending retractably from the vertical support close to the lower end;

two pivot latch assemblies formed on the bracket assemblies and the vertical supports to keep the vertical supports from inadvertently folding; and two legs mounted respectively around the vertical supports, and each leg having a lower end, each leg being hollow and mounted telescopically around the corresponding vertical support and further having multiple locking holes defined in a longitudinal line through each leg and corresponding to the retractable latch on a corresponding vertical support.

8. A foldable bath bench comprising:

a seat assembly having a front;

a rear;

two opposite sides;

two transverse crossbars mounted respectively at the front and rear, and each transverse crossbar having two opposite ends;

two backrest brackets being hollow and mounted longitudinally below the transverse crossbars; and at least one seat mounted on the transverse crossbars;

two leg assemblies mounted on the opposite sides of the seat assembly, and each leg assembly having:

two bracket assemblies corresponding to and mounted respectively on the ends of the transverse crossbars;

two vertical supports attached respectively to the bracket assemblies, selectively pivoting relative to the ends of the transverse crossbars and each vertical support having an upper end and a lower end;

two pivot latch assemblies formed on the bracket assemblies and the vertical supports to keep the vertical supports from inadvertently folding; and two legs mounted respectively around the vertical supports, and each leg having a lower end; and a backrest assembly mounted detachably on the seat assembly and having:

a backrest; and two mounting tubes attached to the backrest and having two distal ends detachably mounted in the backrest brackets of the seat assembly.

* * * * *